US007528852B2

(12) United States Patent
Lee

(10) Patent No.: US 7,528,852 B2
(45) Date of Patent: May 5, 2009

(54) METHOD OF DIFFERENTIATING TYPES OF HEAT SENSITIVE PAPER

(75) Inventor: Hyun-Jun Lee, Suwon-si (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 296 days.

(21) Appl. No.: 11/135,513

(22) Filed: May 24, 2005

(65) Prior Publication Data

US 2005/0271866 A1 Dec. 8, 2005

(30) Foreign Application Priority Data

Jun. 2, 2004 (KR) ..... 10-2004-0039978

(51) Int. Cl.
*B41J 2/00* (2006.01)

(52) U.S. Cl. ..... 347/193

(58) Field of Classification Search ..... 347/193
See application file for complete search history.

(56) References Cited

U.S. PATENT DOCUMENTS

| | | | | |
|---|---|---|---|---|
| 4,827,123 | A * | 5/1989 | Gray | 356/28 |
| 5,139,339 | A | 8/1992 | Courtney et al. | 356/446 |
| 5,774,146 | A | 6/1998 | Mizutani | 347/43 |
| 2002/0126197 | A1* | 9/2002 | Minowa et al. | 347/193 |
| 2004/0021724 | A1* | 2/2004 | Kojima | 347/19 |

FOREIGN PATENT DOCUMENTS

| | | |
|---|---|---|
| JP | 02-063872 | 3/1990 |
| JP | 4-282264 | * 10/1992 |
| JP | 06-206364 | 7/1994 |
| JP | 07-196207 | 8/1995 |
| JP | 07-267507 | 10/1995 |
| JP | 2000-108433 | 4/2000 |
| JP | 2002-292915 | 10/2002 |
| KR | 1995-0025588 | 4/1999 |
| KR | 1998-0067424 | 8/1999 |
| KR | 2002-0067075 | 8/2002 |
| KR | 2003-0014853 | 2/2003 |

OTHER PUBLICATIONS

Korean Office Action dated Oct. 28, 2005 with translation.

* cited by examiner

*Primary Examiner*—Julian D Huffman
(74) *Attorney, Agent, or Firm*—Roylance, Abrams, Berdo & Goodman LLP

(57) ABSTRACT

A method of differentiating a type of heat sensitive paper is provided. The method comprises the steps of a) printing a test pattern on a surface of the heat sensitive paper using a thermal printhead, b) detecting the test pattern using an optical sensor, c) determining whether a value of an optical output of the detected test pattern is within a range previously defined in a lookup table, and d) if the value of the optical output is within the range, printing a printing data on the heat sensitive paper.

10 Claims, 5 Drawing Sheets

METHOD OF DIFFERENTIATING TYPES OF HEAT SENSITIVE PAPER

CROSS-REFERENCE TO RELATED PATENT APPLICATION

This application claims the benefit under 35 U.S.C. §119 (a) of Korean Patent Application No. 10-2004-0039978, filed on Jun. 2, 2004, in the Korean Intellectual Property Office, the entire disclosure of which is hereby incorporated by reference.

BACKGROUND OF THE INVENTION

1. Field of the Invention

The present invention relates to a method of differentiating a type of heat sensitive paper. More particularly, the present invention relates to a method of differentiating a type of heat sensitive paper stacked in a thermal printer.

2. Description of the Related Art

There are two types of thermal printers, direct thermal printers and thermal transfer printers. Direct thermal printer uses paper which is color-developed based on the heat of a thermal head (referred to as "heat sensitive paper"). The thermal transfer printer uses an ink ribbon that responds to heat and transfers ink from the ink ribbon to conventional paper. Since the thermal transfer printer has to employ a driving unit for driving the ink ribbon, its construction is complicated and expensive. Also, since the ink ribbon is consumable, it must be continuously replaced. It increases the per sheet printing costs.

Referring to FIG. 1, heat sensitive paper 10 comprises a base sheet 11 and first and second ink layers 12 and 13 of a desired color formed on both surfaces of the base sheet 11. The ink layers 12 and 13 may have a single-layer structure of monochromatic ink or a multilayer structure capable of developing at least two colors. For example, the first ink layer 12 is layered with two layers of magenta and yellow, while the second ink layer 13 has a single-layered structure for developing a cyan color. Preferably, the base sheet 11 comprises a transparent material. One example of the heat sensitive paper 10 is disclosed in U.S. Patent Application Publication No. 2003/0125206, which is incorporated herein by reference.

The thermal printer using the heat sensitive paper 10 comprises a thermal printhead (TPH) with heating elements arranged in a direction perpendicular to a feeding direction of paper. In order to print double sides using the single thermal printhead TPH, a first surface of the paper is printed, and then a second surface of the paper is printed by the thermal printhead. If both surfaces are printed, a color image can be seen on the paper, when viewed from one surface of the heat sensitive paper.

FIG. 2 is a schematic view depicting a construction of a conventional thermal printer.

Referring to FIG. 2, the thermal printer comprises a feeding roller 2 for transferring the heat sensitive paper 10, a platen roller 3 for supporting one surface of the paper 10, and a thermal printhead 4 for forming an image on the paper 10 supported by the platen roller 3. The paper 10 passing through the feeding roller 2 and an idle roller 5 is pressed towards the feeding roller 2 by the idle roller 5.

Meanwhile, the heat sensitive paper 10 can have different characteristics depending upon the manufacturer or the date of manufacture. The same manufacturer may manufacture different types of paper according to a desired printing quality. In particular, a thermal profile transferred to the heat sensitive paper from the thermal printhead may be different according to the type of heat sensitive paper used to obtain the best print quality.

Therefore, there is a need of a method for differentiating the type of heat sensitive paper in a thermal transfer printer.

SUMMARY OF THE INVENTION

The present invention provides a method of differentiating the type of heat sensitive paper used in a thermal printer.

According to an aspect of the present invention, there is provided a method of differentiating the type of heat sensitive paper, comprising the steps of: a) printing a test pattern at at least one position on one side of the heat sensitive paper by a thermal printhead; b) detecting the test pattern by an optical sensor; c) determining whether a value of an optical power of the detected test pattern is within a range previously defined in a lookup table; and d) if the value of an optical power is within the range, printing a printing data on the heat sensitive paper.

The heat sensitive paper may have a printing region and a cut region formed at a front end of the printing region when viewed from a printing direction, and the test pattern may be printed on the cut region.

The step of d) may comprise the steps of: comparing the value of the optical power with a reference value stored in the lookup table; and if a difference between the value of the optical power and the reference value is above a desired value, compensating a print density.

The compensating process may adjust a print density of the printing data transferred to the thermal printhead.

Also, the compensating process may be separately performed depending upon a color printed on a particular surface of the paper.

The step of b) may be performed when the paper is fed in a printing direction, and the optical sensor may be placed at a front of the thermal printhead when viewed from the printing direction.

BRIEF DESCRIPTION OF THE DRAWINGS

The above and other features and advantages of the present invention will become more apparent by describing in detail exemplary embodiments thereof with reference to the attached drawings in which.

Throughout the drawings, it should be noted that like reference numbers are used to depict the same or similar elements, features and structures.

DETAILED DESCRIPTION OF EXEMPLARY EMBODIMENTS

The present invention will now be described more fully hereinafter with reference to the accompanying drawings, in which exemplary embodiments of the invention are shown.

Figure 1:
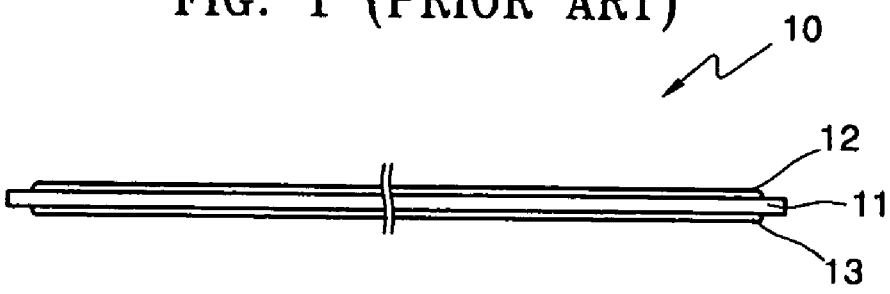
FIG. 1 (PRIOR ART)
FIG. 1 is a cross-sectional view of a conventional heat sensitive paper.
Figure 2:
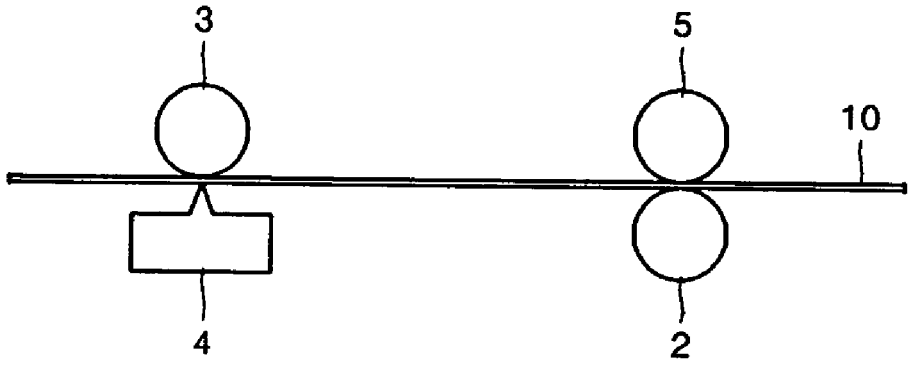
FIG. 2 (PRIOR ART)
FIG. 2 is a view depicting a construction of a conventional thermal printer.
Figure 3:
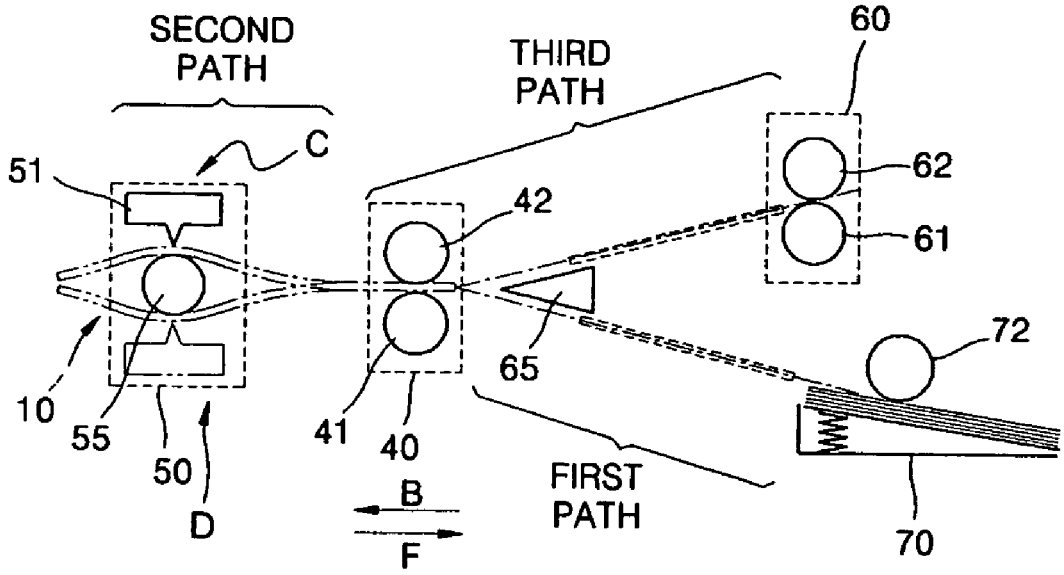
FIG. 3 is a view depicting a method of differentiating the type of heat sensitive paper according to an embodiment of the present invention.

FIG. 3 is a view depicting a thermal printer applied to a method of differentiating the type of heat sensitive paper according to an embodiment of the present invention.

As shown in FIG. 3, the thermal printer comprises at least three paths, that is first, second and third paths, to transfer heat sensitive paper 10. The first path is a path for supplying the paper 10 to the second path. In the second path, the paper 10 is fed backward in a direction indicated by an arrow B, and is then fed forward in a direction indicated by an arrow F (the printing direction) for printing an image on the paper 10. The third path is a path in which the printing paper 10 is positioned, when the paper 10 with only the first surface printed is returned to the second path, while the paper 10 with first and second surfaces completely printed is finally ejected.

A paper guide 65 is interposed between the first and third paths to guide the paper 10 from the first path to the second path and also guide the paper 10 from the second path to the third path. In addition, the paper guide 65 also guides the paper 10 fed from the second path to the third path not to the first path, and guides the paper 10 fed from the first path only to the second path. A construction of the paper guide 65 is widely known, the detailed description of which is not further described herein.

The formation of the image is achieved by an image forming unit 50 in the second path. The formation of the image is performed twice, but, if necessary, may be performed several times. In this embodiment, the formation of the image is performed once per each of the first and second surfaces of the paper 10. Prior to the formation of image on the first and second surfaces of the paper 10, a thermal printhead (TPH) 51 and a platen roller 55 have to be positioned at a desired position in the image forming unit 50. For example, if the image is formed on the first surface of the paper 10, the thermal printhead 51 is positioned at a position C. On the other hand, if the image is formed on the second surface of the paper 10, the thermal printhead 51 is positioned at a position D. Preferably, the position of the thermal printhead 51 is changed by rotating the platen roller 55 and the thermal printhead 51 around a rotating shaft of the platen roller 55. The position of the thermal printhead 51 is changed when the thermal printhead does interfere with the paper 10, for example, before the paper 10 is supplied from the first path or the paper is not returned to the second path after the paper is transferred to the third path at the image formation on the first surface of the paper.

If the paper 10 of which the image has been formed on the first surface is fed backward to the second path, the image formation is performed on the second surface by the thermal printhead 51 of which a posture is changed. In this case, the paper 10 is gradually moved forward by a paper transferring unit 40. After the image formation is completed on the second surface, the paper finally passes the second path to be ejected through a paper ejecting unit 60. The paper transferring unit 40 comprises a feeding roller 41 for transferring the paper, and an idle roller 42 for pressing the paper entering between the feeding roller and the idle roller against the feeding roller 41.

Reference numeral 70 indicates a paper stacking unit, and reference numeral 72 indicates a pickup roller for supplying the paper.

The paper ejecting unit 60 comprises an ejecting roller 61 and an idle roller 62. One roller may be adapted to function as both rollers 61 and 62.

Figure 4:
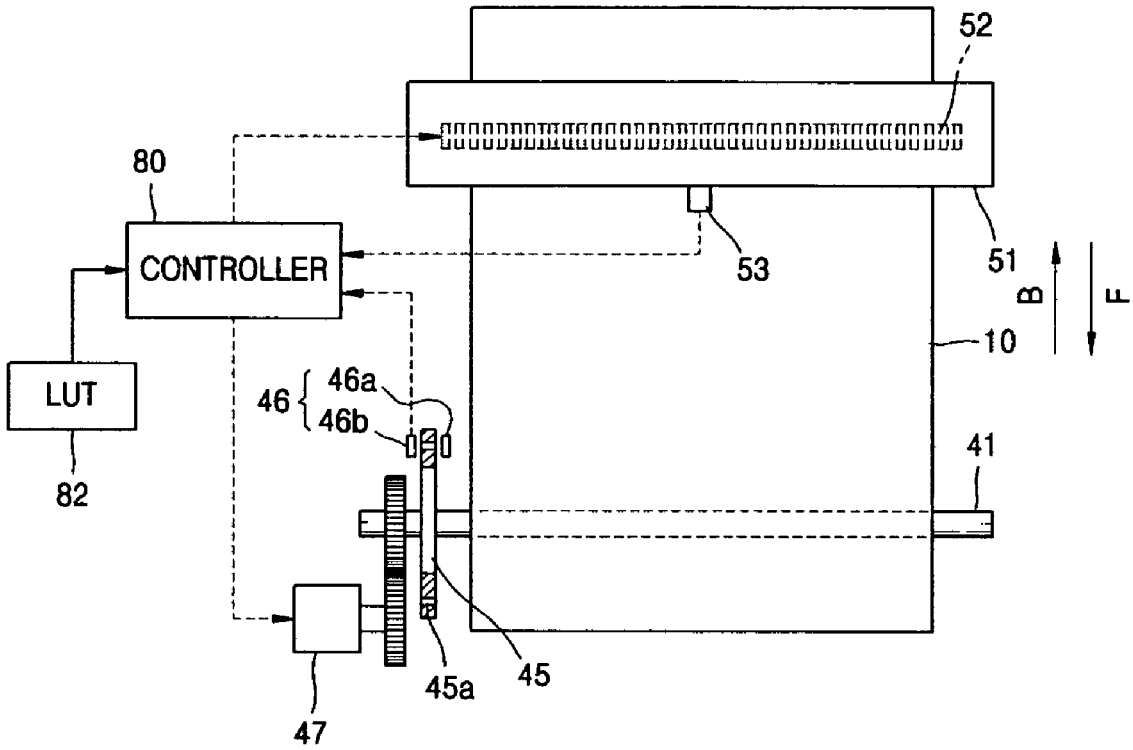
FIG. 4 is a schematic view depicting a part of a thermal printer applied to a method of differentiating a type of heat sensitive paper according to an embodiment of the present invention.
Figure 5:
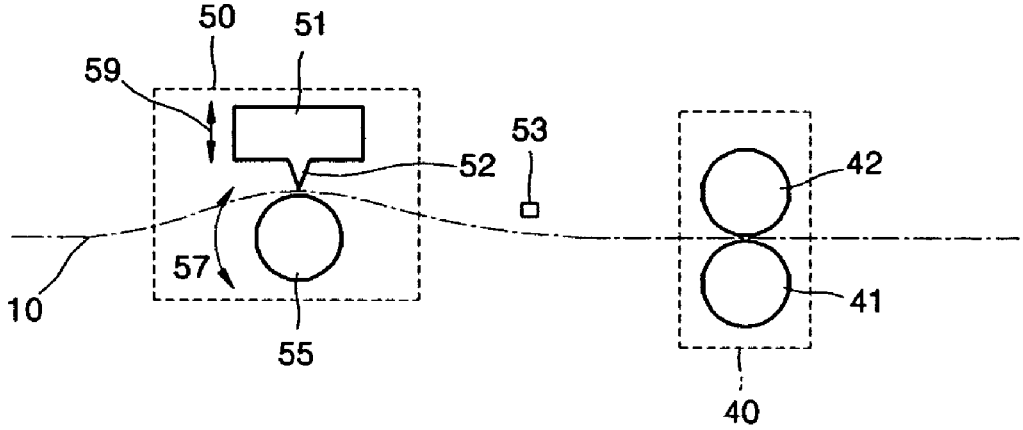
FIG. 5 is a side view of FIG. 4.

FIG. 4 is a schematic view depicting a part of the thermal printer applied to a method of differentiating the type of heat sensitive paper according to an embodiment of the present invention. FIG. 5 is a side view of FIG. 4.

Referring to FIGS. 4 and 5, the heat sensitive paper 10 entering between the platen roller 55 and the thermal printhead 51 is controlled by a step of feeding by the feeding roller 41. Reference numeral 53 indicates a sensor, for example, an optical sensor, for detecting a test pattern formed on the paper 10 and an edge of the paper 10.

The thermal printhead 51 is provided with a plurality of heating elements 52 arranged in a row or rows direction perpendicular to a paper transferring direction. Each heating elements 52 generates heat at a desired temperature for a desired time according to a voltage applying signal. A thermal profile of the electric heating device 52 may be varied depending upon the type of the paper 10, as well as the color of the ink.

The paper 10 is fed in a backward feeding direction indicated by the arrow B, and is fed in a printing direction indicated by the arrow F, by the feeding roller 41. An encoder disc wheel 45 is mounted to one side of the feeding roller 41. The encoder disc wheel 45 is provided at an edge thereof with slits 45*a* at a constant interval. An encoder sensor 46 consisting of a light emitting portion 46*a* and a light receiving portion 46*b* is mounted to both sides of the slit 45*a*, respectively. The light emitting portion 46*a* of the encoder sensor 46 emits light at a predetermined interval, and the light receiving portion 46*b* produces a pulse signal whenever it meets the slit 45*a*. A controller 80 counts the pulse signal to measure a transferring distance of the paper 10 moved by the feeding roller 41, and drives a driving motor 47 to control the transferring distance of the paper 10 moved by the feeding roller 41.

A lookup table 82 is a table for displaying a value of an optical output of the test pattern printed on the paper 10, a detailed description of which will be followed below.

The thermal printer comprises rotating means 57 for rotating the thermal printhead 51 and the platen roller 55 for printing the second surface of the paper 10 after the first surface is printed, and vertical moving means 59 for spacing from and approaching the thermal printhead 51 to the printing path. The thermal printhead 51 is spaced from the platen roller 55 at a predetermined gap, for example, 1 to 2 mm, by use of the vertical moving means 59, so that the paper 10 easily passes through between the thermal printhead 51 and the platen roller 55 when the paper is fed backward.

The optical sensor 53 detects the test pattern printed on the paper 10 to output the value of the optical output of the test pattern to the controller 80.

Figure 6:
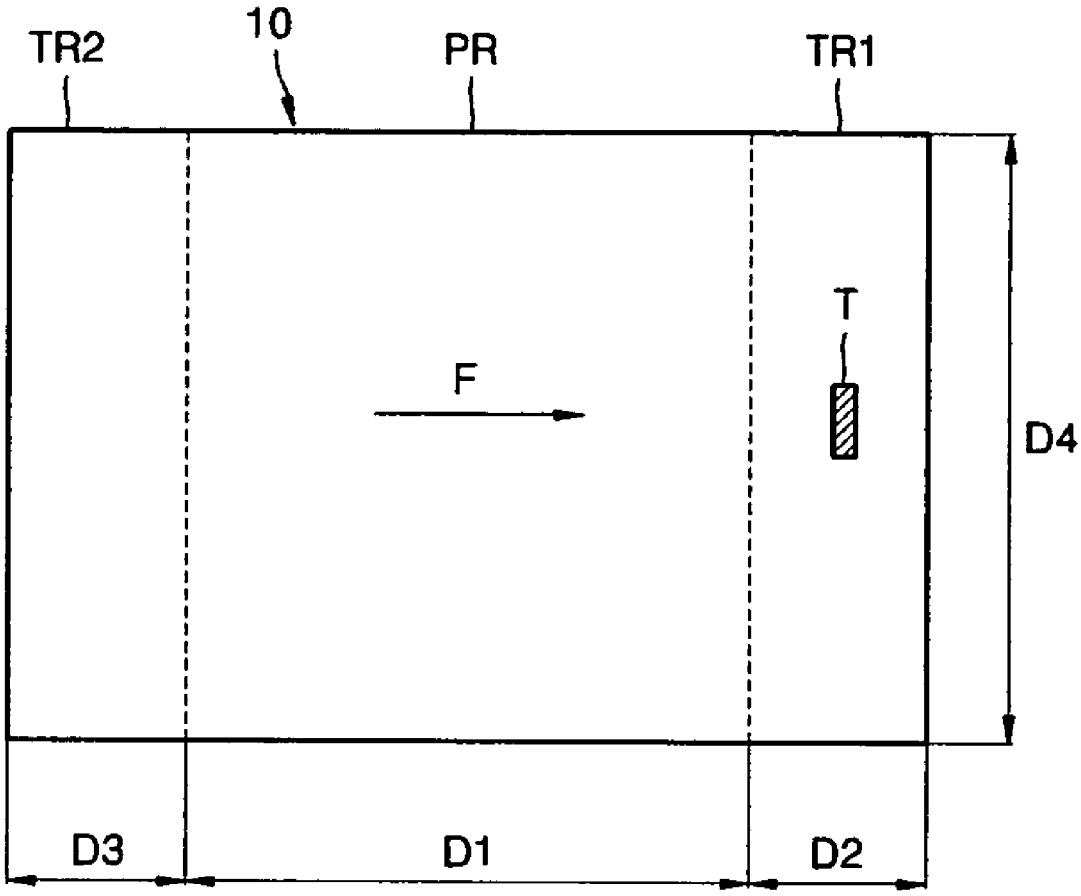
FIG. 6 is a view depicting an example of heat sensitive paper applied to an exemplary embodiment of the present invention.

FIG. 6 is a view depicting an example of the heat sensitive paper applied to an embodiment of the present invention.

Referring to FIG. 6, the heat sensitive paper 10 is divided into a printing region PR and tear regions TR1 and TR2 after printing. In this example, a crosswise length D1 of the printing region PR is 6 inches, and a lengthwise length D4 is 4 inches. Meanwhile, crosswise lengths D2 and D3 of the first tear region TR1 and the second tear region TR2 are about 1 inch. Of course any suitable dimensions could be used. The direction indicated by the arrow F shows a direction where the paper 10 is transferred when forward feeding. The referral letter T shows the test pattern, which is not limited to its shape but is sufficient to be detectable by the optical sensor 53.

The method of differentiating the type of heat sensitive paper according to embodiments of the present invention will now be described in detail with reference to the accompanying drawings.

Figure 7:
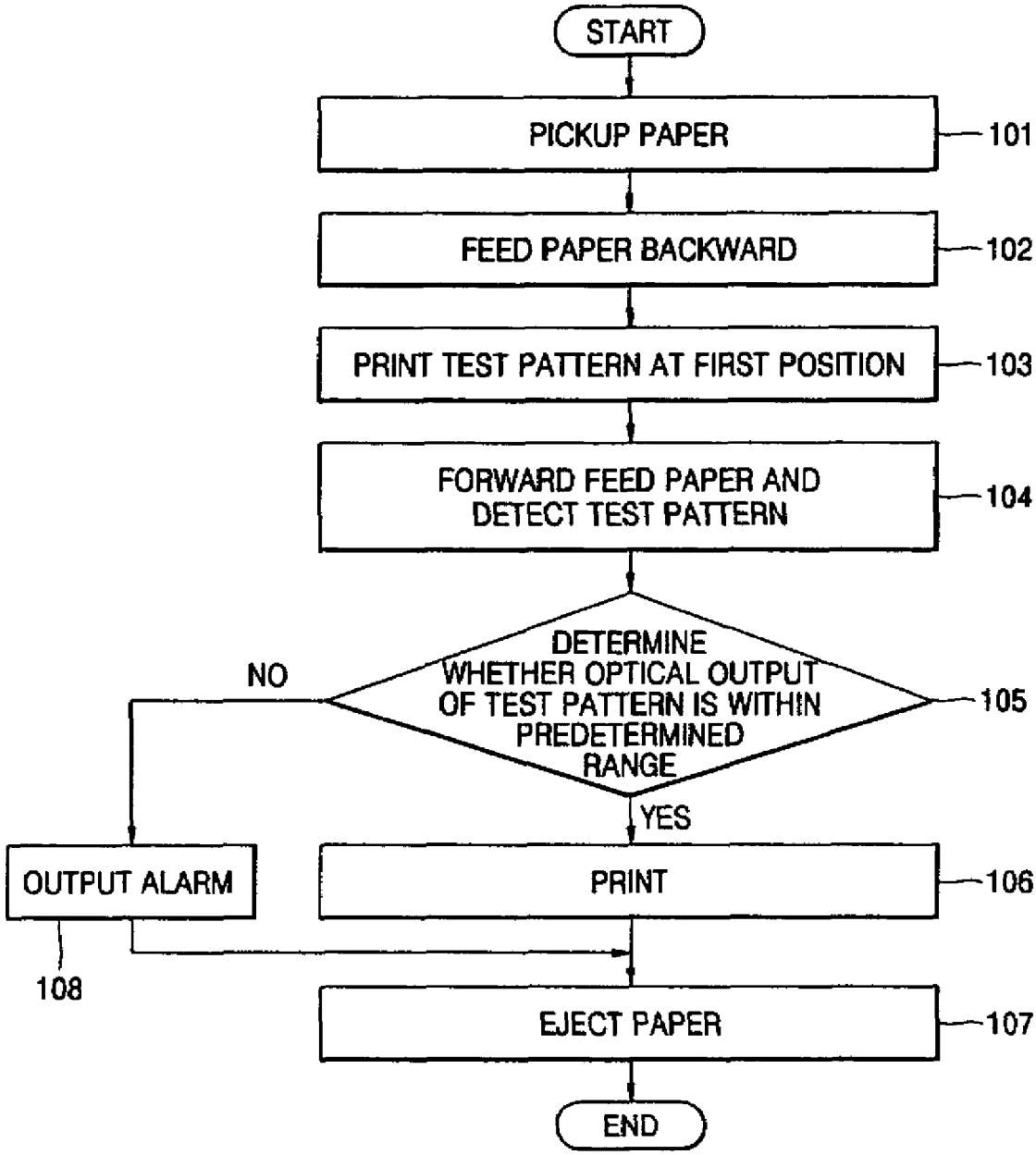
FIG. 7 is a flowchart of a method of differentiating the type of heat sensitive paper according to an embodiment of the present invention.

FIG. 7 is a flowchart of a method of differentiating the type of heat sensitive paper according to an embodiment of the present invention.

When a print command is input to the controller from a computer connected to the printer, a sheet of paper 10 is picked up from the paper stacking unit 70 by means of the pickup roller 72, and enters into the first path at step 101.

The paper 10 entered into the first path is guided to the feeding roller 41 by the paper guide 65, and the feeding roller 41 feeds the paper 10 backward into the second path at step 102, as shown in FIG. 3. At that time, the paper 10 can be fed backward at desired distance from the time when a rear end of the paper is detected by the optical sensor 53. Specifically, the encoder sensor 46 detects the rotation of the rotary encoder wheel 45 installed onto a periphery of a shaft of the feeding roller 41 for outputting a pulse signal to the controller 80, such that the controller 80 counts the pulse signal to control the backward feeding distance.

Figure 8:
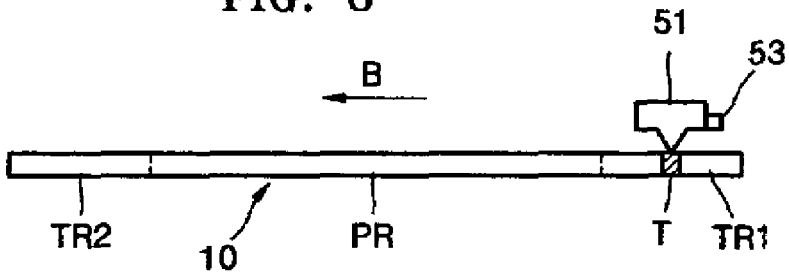
FIG. 8 is a view depicting a method of differentiating the type of heat sensitive paper according to an embodiment of the present invention.

At step 102, as shown in FIG. 8, when a first position of the first tear region TR1 reaches a lower portion of the thermal printhead 51, the backward feeding process is stopped. Then, the test pattern (T) previously determined is printed on the first position at step 103. At that time, the test pattern T may be printed to discriminate each of color images Y, M and C.

Then, the paper 10 is fed forward to the printing direction by reversing the feeding roller 41, and the test pattern T formed on the first surface of the paper 10, which is the upper surface in the drawings, is detected by means of the optical sensor 53. The optical sensor 53 detects the test pattern T for outputting an optical output signal to the controller 80.

The controller 80 determines whether the value of the optical output of the test pattern T is within a range previously defined and stored in the lookup table 82 at step 105.

Table 1 shows one example of the lookup table 82.

TABLE 1

| Color | Yellow Y | Magenta M | Cyan C |
|---|---|---|---|
| Value of optical output | 0.4~0.5 | 1.1~1.2 | 1.2~1.3 |

From Table 1, it will be appreciated that each value of the optical output per color of a specific paper is within a desired range.

When the value of the optical output is within the range at step 105, the paper 10 is determined as a paper wanted by the user, and print data is printed on the paper 10 at step 106.

After completing the print, the paper 10 is ejected at step 107.

When the value of the optical output is not within the range at step 105, the paper 10 is determined as a paper not wanted by the user, and the controller outputs an alarm to the user at step 108.

Figure 9:
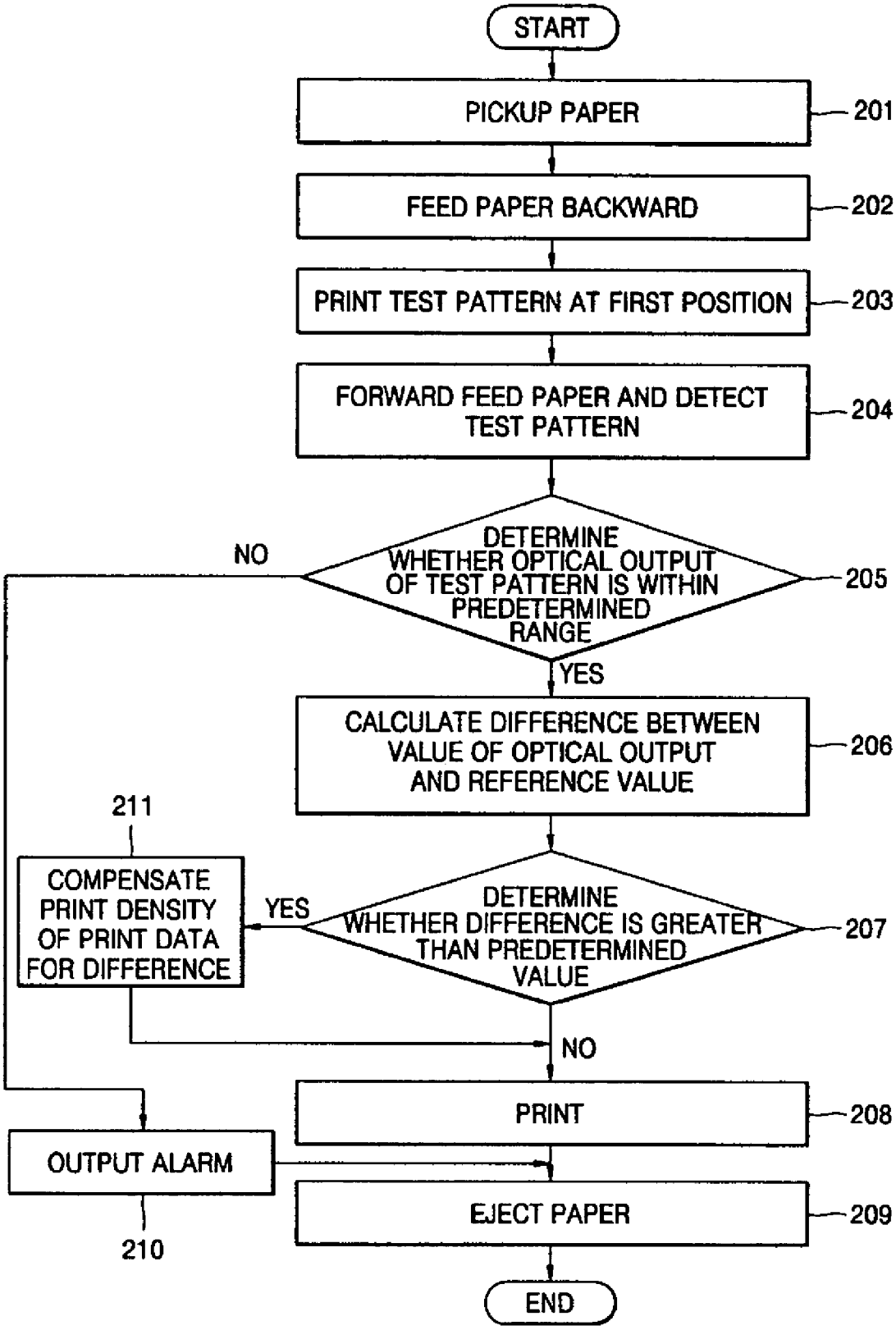
FIG. 9 is a flowchart of a method of differentiating the type of heat sensitive paper according to an embodiment of the present invention.

FIG. 9 is a flowchart of a method of differentiating the type of heat sensitive paper according to an embodiment of the present invention.

The method of differentiating the type of heat sensitive paper according to an embodiment of the present invention will now be described with reference to FIG. 9.

When a print command is input to the controller from a computer connected to the printer, a sheet of paper 10 is picked up from the paper stacking unit 70 by means of the pickup roller 72, and enters into the first path at step 201.

The paper 10 entered into the first path is guided to the feeding roller 41 by the paper guide 65, and the feeding roller 41 feeds the paper 10 backward into the second path at step 202. At that time, the encoder sensor 46 can control the distance of backward feeding paper 10 from the time when a rear end of the paper is detected by the optical sensor 53.

At step 202, as shown in FIG. 8, if a first position of the first tear region TR1 reaches a lower portion of the thermal printhead 51, the backward feeding process is stopped. Then, the test pattern T previously determined is printed on the first position at step 203.

Then, the paper 10 is fed forward to the printing direction by reversing the feeding roller 41, and the test pattern T formed on the first of the paper 10, which is the upper surface in the drawings, is detected by means of the optical sensor 53. The optical sensor 53 detects the test pattern T for outputting an optical sensor to the controller 80.

The controller 80 determines whether the value of the optical output of the test pattern T is within a range previously defined and stored in the lookup table 82 at step 205.

When the value of the optical output is within the range at step 205, the controller 80 calculates a difference (variation) between the value of optical output and a reference value stored in the lookup table 82 at step 206.

The controller determines whether the variation is above a predetermined value at step 207.

When the variation is less than the predetermined value at step 207, the printing process is performed at step 208, and the paper 10 is ejected when printing is completed at step 209.

When the variation is greater than the predetermined value at step 207, the controller compensates for the variation in a print density of the print data transferred to the printer at step 211. For example, a variation in a print density of an original print data is compensated for, so that it is transformed into a new print data. The method of reflecting the variation on the print density of the print data is widely known, the description of which will be omitted.

Then, the printing process is performed with the print data newly transformed at step 208. When the printing process is completed, the paper is ejected at step 209.

When the value of the optical output is not within the range at step 205, the paper 10 is determined as a paper not wanted by the user, and the controller outputs an alarm to the user at step 210. Then, the paper is ejected at step 209.

In an embodiment, the process of printing the test pattern and detecting the test pattern may be performed on any one of magenta, cyan, and yellow. In addition, when printing the first surface, detection and compensation of the test pattern are simultaneously performed regarding two colors formed on the first surface, respectively, and when printing the second surface, the process may be performed regarding one color formed on the second surface.

According to the method of differentiating the type of heat sensitive paper in accordance with an embodiment of the present invention, a type of heat sensitive paper is detected, and the paper unsuitable for using the thermal printer is ejected prior to printing. In addition, a suitable paper is also checked to compensate for the variation of the actual print density and thereby to obtain an image having of a good quality.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of differentiating a type of heat sensitive paper, comprising the steps of:

a) printing a test pattern on a surface of the heat sensitive paper using a thermal printhead;

b) detecting the test pattern using an optical sensor;

c) determining whether a value of an optical output of the detected test pattern by the optical sensor is within a color range previously defined in a lookup table or not, wherein the color range includes at least two of yellow color range, magenta color range, and cyan color range; and d) if the value of the optical output is within the color range previously defined in the lookup table, printing a print data on the heat sensitive paper.

2. The method of claim 1, wherein the heat sensitive paper has a printing region and a tear region formed at a front portion of the printing region in a printing direction, and the test pattern is printed on the tear region.

3. The method of claim 1, wherein the heat sensitive paper has a printing region and a tear region formed at a front portion of the printing region in a printing direction, and the test pattern is printed on the printing region.

4. The method of claim 1 wherein the heat sensitive paper has a printing region and a tear region formed at a front portion of the printing region in a printing direction, and the test pattern is printed on the printing region and the tear region, respectively.

5. The method of claim 1, wherein the step of b) is performed when the paper is fed in a printing direction and the optical sensor is placed at a front of the thermal printhead in the printing direction.

6. The method of claim 1, wherein the step of d) comprises the steps of:

comparing the value of the optical output with a reference value stored in the lookup table; and if a difference between the value of the optical output and the reference value is above a predetermined value, compensating a print density.

7. The method of claim 6, wherein the step of compensating the print density comprises the step of adjusting the print density of the print data transferred to the thermal printhead.

8. The method of claim 7, wherein the test pattern comprises a plurality of color images, and wherein the step of compensating the print density is performed with respect to each color image of the test pattern on the surface of the paper, respectively.

9. The method of claim 1, further comprising the step of ending the printing if the value of the optical output is out of the color range previously defined in the lookup table.

10. The method of claim 9, wherein the step of ending the printing further comprises the step of outputting an alarm to a user.

* * * * *